United States Patent [19]

Lendvay

[11] 4,244,381

[45] Jan. 13, 1981

[54] UPGRADED TOBACCO STEM MATERIAL AND ITS METHOD OF PREPARATION

[75] Inventor: Andrew T. Lendvay, Richmond, Va.

[73] Assignee: Philip Morris Incorporated, New York, N.Y.

[21] Appl. No.: 930,333

[22] Filed: Aug. 2, 1978

[51] Int. Cl.[3] ..... A24B 3/14

[52] U.S. Cl. ..... 131/17 A; 131/140 C; 131/140 P

[58] Field of Search ..... 131/8, 9, 2, 17, 15 R, 131/15 C, 140 C

[56] References Cited

U.S. PATENT DOCUMENTS

| | | | |
|---|---|---|---|
| 3,529,602 | 11/1970 | Hind et al. | 131/140 C |
| 3,529,606 | 9/1970 | de la Burde et al. | 131/140 P |
| 3,818,915 | 6/1974 | Anderson | 131/2 |
| 3,844,294 | 10/1974 | Webster | 131/2 |
| 3,885,575 | 5/1975 | Parkes et al. | 131/2 |
| 3,894,543 | 7/1975 | Anderson et al. | 131/2 |
| 4,014,348 | 3/1977 | Garner | 131/2 |
| 4,131,118 | 12/1978 | Gellatly et al. | 131/140 C |
| 4,133,317 | 1/1979 | Briskin | 131/2 |

FOREIGN PATENT DOCUMENTS

| | | | |
|---|---|---|---|
| 735353 | 8/1973 | South Africa | 131/2 |
| 1362613 | 8/1974 | United Kingdom | 131/2 |
| 1362751 | 8/1974 | United Kingdom | 131/2 |

OTHER PUBLICATIONS

Tobacco and Tobacco Smoke by Wynder et al., p. 54 cited, Academic Press, 1967, New York, N. Y.

*Primary Examiner*—V. Millin

*Attorney, Agent, or Firm*—Watson, Leavenworth, Kelton & Taggart

[57] ABSTRACT

A method of upgrading tobacco by-product material, such as stems, into a smokable filler component such that it can beneficially be blended with conventional tobacco filler to impart a mild smoke with low impact and no undesirable "woody taste" is disclosed. The method for producing this upgraded tobacco by-product material comprises subjecting the material to a heat treatment step such that it experiences a weight loss of at least 10% and a water extraction step such that water soluble constituents contained within the material are removed therefrom. The smoking material obtained by such method is also described.

23 Claims, No Drawings

UPGRADED TOBACCO STEM MATERIAL AND ITS METHOD OF PREPARATION

BACKGROUND OF THE INVENTION

This invention pertains to the field of smoking materials. More particularly, the present invention concerns a method fo upgrading tobacco by-product material, particularly tobacco stems, such that it will not possess its inherent "woody taste" and will be mild and possess low impact such that it can be incorporated into a smoking material.

As a result of the stripping of leaf tobacco in preparation for its use for cigar wrappers or fillers, cigarettes and smoking tobacco, tobacco by-products, such as, stems, stalks and leaf scraps are collected. These by-products have not been usable for direct incorporation in smoking product, although some have been used for making snuff and for mixture with chewing tobacco. Tobacco dust and the like have also been recovered from shipping and handling of tobacco. Although attempts have been made in the past to economically utilize these tobacco by-products by forming "reconstituted" tobacco therefrom (see, for example, U.S. Pat. Nos. 3,409,026 and 3,386,449), such reconstituted tobacco has frequently been found to be undesirable due to the harshness, poor aromatic qualities and off-taste of the smoke produced by this material even when it is combined with natural leaf tobacco and used in very small quantities. This is particularly true where attempts have been made to utilize Burley tobacco by-products.

Prior art techniques have utilized thermal degradation or "pyrolysis" of a carbohydrate or cellulosic material in an inert atmosphere for subsequent incorporation with tobacco leaf material. The pyrolysis carried out is such that it subjects the cellulosic or carbohydrate material to extreme thermal degradation such that a weight loss of generally about 60% or more is sustained by the treated material. The pyrolyzed material assumes a grayish-black color as a result of this treatment. Such techniques are disclosed, for example, in U.S. Pat. Nos. 3,861,401, 3,861,402 and 4,019,521.

The above techniques suffer from many disadvantages. In particular, they generally all require the addition of materials which are foreign to tobacco. These foreign materials may detract from and adversely affect the acceptability of the smoking product which contains such additives.

Moreover, the extreme thermal degradation which is carried out in these techniques is undesirable inasmuch as the material suffers structural breakdown, becomes brittle and unable to reabsorb moisture and retain the necessary flexibility. By exposing the material to controlled heat treatment which results in a weight loss of approximately 30%, the material will retain flexibility and moisture content comparable to the other portions of tobacco filler to which it is intended to be blended.

SUMMARY OF THE INVENTION

Applicant has discovered a method for upgrading tobacco by-product material, particularly stems, to be economically and beneficially utilized in a smoking material. The smoking material which contains the upgraded tobacco by-product material has no undesirable "woody taste" or the harshness and undesirable aromatic qualities of prior art products which utilize such tobacco by-products.

More importantly, Applicant has discovered a method which avoids substantially all of the above-noted disadvantages inherent in prior art techniques. Thus, the upgraded tobacco by-product materials of the present invention is composed of 100% tobacco plant material and does not require the use of foreign, non-tobacco material, e.g., chemical reagents or treated cellulose, in order to obtain the desired objective. This invention makes possible the economic utilization of tobacco by-product materials, particularly stems, while at the same time, removing the undesirable "woody taste" normally associated with such materials.

More particularly, the present invention is directed to a method of upgrading tobacco by-product material such that it can subsequently be combined with natural leaf tobacco and/or reconstituted tobacco to form a smokable material. In particular, the method comprises subjecting the by-product material to a heat treatment step such that it experiences a weight loss of at least 10% and a water extraction step such that water soluble constituents contained within the by-product material are removed therefrom.

The fact that 100% tobacco plant material is being used in lieu of foreign additives, produces a highly desirable product, not only from an economic point of view, but also from a marketing consumer point of view.

This invention produces an ultimate smokable material which is low in cost, makes use of so-called "by-product" materials to form a commercially acceptable product and is produced in a simple and efficient manner.

DETAILED DESCRIPTION OF THE INVENTION

The method of producing the upgraded tobacco by-products of the present invention is generally carried out as follows:

Although tobacco by-product material generally includes tobacco fines, dust, stems and stalks, the process of the present invention is most advantageously used with tobacco stems inasmuch as it is these materials which, above all, produce the undesirable characteristics of reconstituted tobacco when these particular materials are contained therein. This method is particularly suitable for Burley stem material.

The tobacco by-product material is subjected to two independent treatment steps: (a) a heat treatment step and (b) a water extraction step. The order in which these two steps are carried out is not critical to the present invention. Thus, if desired, the water extraction step may be performed first followed by the heat treatment step. Alternatively, the heat treatment step can be performed first followed by the water extraction step. Preferably, however, for pragmatic reasons, it is more desirable to first extract the stems to the desired degree before shredding and then heat treating the resultant shreds.

Generally, the tobacco by-product material is heat treated by subjecting the material to mild thermal degradation at a temperature of about 150° C. to 370° C. for periods ranging from two seconds to one hour, depending on the treatment temperature and the weight loss desired. Preferably, however, the temperature is between 175° C. and 345° C.

The heating of the tobacco by-product material may take place in an oxidizing atmosphere, such as air, up to a temperature of about 250° C. or may alternatively be carried out in an inert atmosphere such as nitrogen, carbon dioxide, helium and the like. Preferably, beyond a temperature of 250° C., only an inert atmosphere will be employed to avoid possible self ignition of the material. However, if the duration of the heat treatment is short enough, e.g., seconds only, the use of air atmosphere with optional use of steam may be employed. This is to ensure that oxidation or burning of the tobacco by-product material does not take place, but rather, mild thermal degradation.

In lieu of the inert atmosphere, the non-oxidation condition may also be acquired by carrying out the heat treatment under vacuum conditions.

Heating for the heat treatment step may be derived from any convenient source such as, for example, radiant heat, oil heat, gas heat, steam, electricity, microwave energy, and the like.

The heat treatment is carried out to the extent that the tobacco by-product material experiences a weight loss of at least 10%, but no more than 35%. Preferably, the weight loss, on a dry weight basis, is from about 15 to 30%. Below about 10% weight loss, the so treated material still delivers the undesirable "woody tasting" smoke. Similarly, above a weight loss of about 35% too much structural carbohydrate seems to break down and the so treated material has a tendency to become brittle with a loss of flexibility after absorption of moisture. It should be noted, however, that there is no sharp dividing line at a weight loss of about 35% since the changes are gradual. Additionally, where the tobacco by-product material is first water extracted and then heat treated, the extent of the heat treatment step is somewhat dependent on the extent of water extraction, i.e., the amount of extractables removed during the water extraction step. Thus, the heat treatment of the present invention is similar to a "toasting" of the tobacco by-product material. This produces a golden-brown, aromatic smelling material. In contrast, extreme thermal degradation of prior art techniques involves a complete "pyrolysis" of the material which produces a greyish-black, friable carbonized material with no structural integrity, which will fall apart or crunch at the application of even slight pressure.

During the heat treatment, it may be desirable, although certainly not critical to the present invention, to remove volatile organic materials that are produced as a result of the heat treatment process. Such removal of the organic materials may be accomplished by, for example, vacuum means, steam, water, or the like. Alternatively, the volatiles may be removed by maintaining the heat treatment chamber under positive pressure such that the volatile materials are forced out of the chamber. Removal of these volatile materials prevent the possibility of their condensing back onto the heat treated tobacco by-product material. It is believed that the removal of these volatile organic materials aids in the production of a better tasting and more aromatic product. Although such a step is desirable, it certainly is not necessary in the process of the present invention.

The tobacco by-product material can be subjected to the heat treatment process in the form of a powder or discrete particles, such as shreds.

In a batch operation, the material is simply loaded into an enclosed chamber in which the specific heat treatment conditions are provided. Thereafter, the material is heated to the temperature desired for thermal degradation and maintained at such temperature for the desired length of time. It is preferable, however, in order to reduce the costs involved, to carry out the heat treatment in a continuous manner wherein the tobacco by-product material is placed on a moving conveyor belt which passes through the enclosed heated chamber at a rate sufficient to achieve the desired degree of mild thermal degradation.

The water extraction step, which as discussed above, may be performed either before or after the heat treatment step, is carried out to remove undesirable water soluble constituents from the tobacco by-product material. Such undesirable water soluble constituents, particularly nitrate salts, and more particularly, potassium nitrate, are generally undesirable in the final smoking product in that they contribute to a harsher smoke having more impact on delivery.

The water extraction step is generally carried out by simply washing or soaking the tobacco by-product material in a manner conventional in the art. Generally, the water extraction step may be carried out in a batch or continuous operation, e.g., countercurrent extraction, etc. which is well-known in the art. The temperature and quantity of water employed may vary depending on the quantity of water solubles desired to be removed. More particularly, whether the water extraction step is carried out before or after the heat treatment, it is desirable that the water be maintained in the range of from about 0.5° C. to 99° C. and most preferably between 10° C. and 80° C.

Generally, the amount of water added to the tobacco by-product material for the extraction step is in the range of from about 5 to 40 times the weight of the by-product material on a dry weight basis. Preferably, the ratio of liquid to solid, on a weight basis, is in the range of from 10:1 to 30:1.

The residence time for the water extraction step, i.e., the amount of time that the by-product material is in contact with the water extraction medium, is determined by quantitative analysis of the water extract and/or the treated material until the desired extraction has been obtained.

While the water extraction step removes the undesirable water soluble constituents from the tobacco by-product material, at the same time, it also removes some water soluble constituents which may be desirable for obtaining a tobacco product having good taste and aroma, e.g., nicotine, sugars, flavorants, etc. Thus, although it is not critical to the present invention, it may be desirable to remove the nitrates from the water extraction medium after the by-product material has been removed therefrom, particularly, the potassium nitrate, such that the desirable water soluble constituents are subsequently recombined with the tobacco by-product material. Generally, the nitrates are removed from the water medium by crystallization or microbiologically. After the nitrates have been removed, the water medium is then concentrated.

To recombine the desirable water soluble constituents with the tobacco material, the former may simply be sprayed onto the tobacco. Other methods for recombining the denitrated water extraction medium with the tobacco by-product material are well within the knowledge of the ordinary skilled art worker. It is understood, of course, that other flavoring materials may also be added to the tobacco material if so desired.

Where desirable, the already extracted tobacco by-product material may be coated with a conventional tobacco casing either before or after the heat treatment step. However, if the tobacco material is coated with the casing prior to the heat treatment step, the temperature levels as well as the time of exposure during the heat treatment step should be modified accordingly. Thus, where the tobacco by-product material has been treated with casing prior to the heat treatment step, the heat treatment is carried out at a temperature in the range of from about 95° C. to 260° C. and preferably about 110° C. to 220° C. The time of heat treatment exposure varies from two seconds to five hours depending upon the particular temperature maintained.

After the tobacco by-product material has been subjected to the heat treatment and water extraction steps discussed above, it is then shredded or comminuted to a form desirable for incorporation into a smokable material. Of course, the tobacco material may be comminuted prior to subjecting it to the various treatment steps. For example, where the tobacco by-product material is cooled in cold water after its heat treatment, is may be reduced in size by subsequent wet grinding. Other methods for reducing the tobacco by-product material to proper size are well-known in the art and can easily be determined by the ordinary skilled art worker.

The upgraded tobacco by-product material may now be used directly as a substitute for strip tobacco in conventional tobacco filler without any undesirable "woody" taste associated therewith. Generally, the amount of treated tobacco by-product material that can be combined with conventional filler is in the range of from 1% to 45% by weight and perferably about 4% to 30%.

In an alternative embodiment of the present invention, untreated stem materials may be added to a conventional slurry used for making reconstituted sheet material and then the combination of these materials are subjected to a heat treatment and water extraction step as is required in the present invention.

The tobacco slurry used for forming the reconstituted tobacco sheet is prepared by any of the processes well-known in the art for preparing reconstituted tobacco. (See, for example, U.S. Pat. No. 3,409,026 incorporated herein by reference).

In general, the tobacco slurry is formed by first grinding tobacco by-product material such as dust, fines, and the like. This ground tobacco material is then mixed with water to form a slurry. To this slurry, the untreated stems and stalks are added. Preferably, however, the stems and stalks are first shredded so that they can be more uniformly dispersed throughout the tobacco slurry. Typically, about 0.1% to 75% and preferably about 0.8 to 60% of stems and stalks may be added to the slurry based on the weight of the tobacco material employed in said slurry. Thereafter, the slurry is homogenized such that a thorough blending of the components takes place to form a uniform homogenous mixture.

The homogenized slurry is then processed to form the desired smoking material. In particular, the slurry may be directly cast, dried, and cut into particulate material similar in physical form to ordinary smoking tobacco. Alternatively, the slurry may be cast in blocks or threads or other shapes as desired. Other techniques for forming the reconstituted tobacco material includes the use of paper-making processes as disclosed in U.S. Pat. No. 3,415,253 incorporated herein by reference. These techniques are commonly known in the art and further details need not be described here.

The reconstituted tobacco material is then subjected to the heat treatment and water extraction steps described above. Also as discussed above, the reconstituted material may also be recombined with the desirable soluble constituents which are removed via the water extraction step. All of the conditions described herein above with respect to the treatment of the stems and stalks alone are also applicable to the treatment of the reconstituted tobacco material.

The technique of incorporating the untreated stem and stalk material within the aforementioned tobacco slurry and then treating the reconstituted tobacco material produced therefrom to the heat treatment step and water extraction step is particularly desirable in that not only are the stem and stalk material treated and improved, but additionally, the remaining tobacco by-product material normally contained within the slurry is also treated. Consequently, the entire treated reconstituted tobacco material is upgraded as a result of this technique.

In yet another embodiment of the present invention, it is also possible to first subject the stems to the heat treatment and water extraction steps described above and then add these treated materials to a tobacco slurry used for preparing the reconstituted tobacco material.

Whether the tobacco by-product material is treated alone and subsequently utilized as a replacement for the scarcer, more expensive grades of tobacco materials, or alternatively, combined with reconstituted tobacco material to be used with a natural leaf filler, the smoking quality of the resulting smoking material is such that it possesses no undesirable "woody" taste or the harshness and undesirable aromatic qualities of prior art products which utilize such tobacco by-products. In fact, based on the subjective evaluations of some of our taste panelists, the smoking materials incorporating the upgraded tobacco by-product material of the present invention has better flavor and aromatic qualities and is milder than smoking materials not containing such treated by-product material at all. More importantly, however, is the fact that the present invention produces an upgraded tobacco by-product material which has no undesirable foreign additives added thereto and is composed of 100% tobacco plant material.

Having described the basic concepts of this invention, the following examples are being set forth to illustrate the same. They are not, however, to be construed as limiting the invention in any manner. All parts and percentages in the examples are by weight.

EXAMPLE 1

Stems of Burley tobacco were flattened and then cut into shreds. Cigarettes were prepared using 10% of the shredded material mixed with a conventional cigarette filler material. Smoking tests were carried out to compare the experimental filler with the conventionally prepared cigarette containing so such by-product material. The smoke from the experimental cigarette was judged as being very harsh, peppery, hot, and having an off-taste described as "woody" or "stemmy."

EXAMPLE 2

Burley tobacco stems were shredded and heated in an electric furnace in an atmosphere of protective gas, i.e., nitrogen, at 260° C. for 5½ minutes. The weight loss experienced by the tobacco was approximately 28.6% by weight. No washing of the stem material was performed.

The resulting brown shreds were used to blend with conventional cigarette filler at levels of 6% and 10%. Control cigarettes were also made without any of the heat-treated Burley stem being included.

The experimental cigarette was smoked and compared to the conventional controlled cigarettes. The smoke from the experimental cigarettes, even with the additive at the 6% level, was harsh and bitter with a "stemmy" off-taste. This was attributable to the lack of the washing step.

EXAMPLE 3

Shredded Burley stems were thermally treated in an electric furnace at 243° C. for 7 minutes. In order to avoid exothermic reactions, portions of the shredded material were packed in aluminum foil so that the heat treatment would be carried out in an almost oxygen-void atmosphere.

After the heat treatment, the packages were placed in a container filled with dry ice. The weight loss was between 28% and 30%.

The heat treated shreds were then washed with warm water at a temperature of 50° C. using ten parts by weight of water and then dried. The shreds were then blended into conventional cigarette filler at the 6% and 10% levels.

When smoked against the control cigarette, which contained no heat-treated, washed by-product material therein, the smoke from the experimental cigarette was judged as being milder than that of the control, had low impact, and was without any off taste, even at the 10% level of addition to the conventional cigarette filler. This experiment shows the importance of both heat treating and washing the tobacco by-product material in order to obtain the desired effect of the present invention.

EXAMPLE 4

Burley stems were first washed using twenty parts by weight of water at 50° C. to remove the water soluble constituents therefrom. The washed stems were then flattened and cut into shreds. The shreds were then dried to a moisture content of about 12–13% and then heat treated in a furnace at 215° C. for 10 minutes. The weight loss experienced by the treated material was a total of 32%. The "toasted" golden brown and good smelling shreds were first equilibrated in a standard atmosphere (75° CF, 60% relative humidity) then they were used in conventional cigarette filler at the 5%, 10% and 25% levels.

The cigarettes were smoked and compared with the smoke from conventional cigarettes. The cigarettes containing all three levels of the heat treated stems judged to be mild tasting with no noticeable stem characteristics in the smoke.

EXAMPLE 5

Burley stems were used to make a sheet by the method conventionally used to produce a reconstituted tobacco sheet. Sheets were packed in aluminum foil and heated at 240° C. for 12 minutes. They were then washed, dried, thrashed and finally blended with strip tobacco at the 10% and 20% levels.

Subjective evaluation of the smoke from the experimental cigarettes show that the smoke was milder than that of the control cigarettes and had no off-taste.

EXAMPLE 6

Reconstituted tobacco sheet, composed of 75% stems and 25% tobacco fines was made by a paper-making process.

The reconstituted sheet was thermally treated in a continuous way by carrying out a heating-washing-drying cycle before the reconstituted sheet material was recombined with the solubles which had been removed previously through a washing process.

The thermal treatment was controlled by altering the velocity of the belt that moved the reconstituted sheet material through the paper-making apparatus as well as adjusting the temperature according to the specific belt velocity. The heat treatment was carried out between two solid metal bands which were moving at the same speed at which the sheet moved. The heating could be controlled to last from 20 seconds at 350° C. to 30 minutes at 180° C. before the washing step was reached. After having been washed, the sheet was dried and the remainder of the steps ordinarily used in the making of the reconstituted sheet by the paper making process were continued.

The material thus treated was added to conventional cigarette filler at the 5%, 10%, and 25% levels. Control cigarettes were made in the conventional manner with the same levels of reconstituted sheet material containing, however, no heat treated, washed tobacco by-product material. The cigarettes with the thermalized additives, when smoked against the control with the non-thermalized additive, were evaluated subjectively as being favored over the controls. This was true for all three levels of addition.

EXAMPLE 7

Burley stems were shredded and then extracted using ten times their weight of 50° C. water. After drying to a 6–7% moisture content, the material showed a weight loss of 23% by weight. The extracted material was then heat treated at 210° C. for 15 minutes resulting in a golden-brown, aromatic smelling product. The weight loss experienced by the Burley stems as a result of the heat treatment step was 12%. The so treated shreds were then used, after moisture reconditioning, in cigarette fillers replacing 5%, 10%, 15%, 20%, 25%, and 30% tobacco material in the filler. With the exception of the cigarettes with 25–30% replacement, they were equal to or milder than the control cigarettes.

EXAMPLE 8

Burley stems were extracted using 20 times their weight of 60° C. water. The extracted stems were flattened and cut to shreds. After drying, the weight loss was approximately 38%. The shreds were then heat treated at 200° C. for 17½ minutes in a band oven with occasional infrared treatment during that time. The heat treated shreds were then used in cigarettes at 10%, 17.5% and 25% levels with conventional filler. All the cigarettes had mild taste and pleasant smoke characteristics.

EXAMPLE 9

Burley stems were extracted using 30 times their weight in 50° C. water and left to soak for one hour. The extracted stems were then separated, flattened and shredded. The weight loss was 42% as a result of the extraction treatment. The liquid extract was concentrated to about 45% solids and then cooled. The supernatant liquid was then decanted from the crystals of potassium nitrate which crystallized out. The extracted shreds were then heat treated in a superheated steam atmosphere at 330° C. for 5 seconds. Thereafter, the heat treated shreds were sprayed with the denitrated liquid concentrate and equilibrated. Cigarettes were prepared with the resulting upgraded tobacco by-product material at 17.5%, 25% and 32.5% levels. Again, they were equal to or preferred over the control cigarettes.

EXAMPLE 10

Burley stems were extracted using 20 times their weight in 60° C. water. After one hour of soaking, the stems were put in a press to press out the liquid. The stems were then passed through a shredder. The shreds as well as the liquid extract were processed as in Example 9 except that the shreds were heat treated in a heating tower for 2 seconds at 371° C. Cigarettes with pleasant smoke characteristics were prepared by blending one part or less of this product with 3 parts of conventional filler.

Variations and modifications may, of course, be made without departing from the spirit and scope of the present invention.

Having thus described my invention, what I desire to secure by Letters Patent is:

I claim:

1. A method of upgrading tobacco by-product material which comprises subjecting the by-product material to an uncatalyzed heat treatment step such that it experiences a weight loss of at least 10% but no more than 35% and a water extraction step such that water soluble constituents contained within the by-product material are removed therefrom wherein either of the said steps may be carried out prior to the other.

2. The method of claim 1, wherein the tobacco by-product material is selected from the group consisting of tobacco stems, dust, fines and blends thereof.

3. The method of claim 1, wherein the tobacco by-product material is Burley stem material.

4. The method of claim 1, wherein the heat treatment step is carried out at a temperature of from 150° to 370° C. and for a time of about two seconds to five hours.

5. The method of claim 1, wherein the heating source for the heat treatment step is derived from radiant heat, gas heat, oil heat, steam, electricity or microwave energy.

6. The method of claim 1, wherein the heat treatment step is carried out in an inert atmosphere.

7. The method of claim 5, wherein the inert atmosphere is comprised of nitrogen, carbon dioxide, helium, or a vacuum.

8. The method of claim 1, wherein as a result of the water extraction step, nitrate salts are removed from the tobacco by-product material.

9. The method of claim 8, wherein potassium nitrate is removed.

10. The method of claim 1, which further includes the step of removing the nitrate salts from the water subsequent to the water extraction step and recombining the remaining water soluble constituents with the tobacco by-product material.

11. The method of claim 1, wherein the water extraction step is carried out at a temperature in the range of from 0.5° to 99° C.

12. The method of claim 11, wherein the temperature is in the range of from 10° to 80° C.

13. The method of claim 1, wherein the amount of water added to the tobacco by-product material during the water extraction step is in the range of from about 5 to 40 times the weight of the tobacco by-product material.

14. The method of claim 13, wherein the amount of water is in the range of from about 10 to 30 times the weight of the tobacco by-product material.

15. The method of claim 1, wherein the treated tobacco by-product material is combined with reconstituted tobacco sheet material.

16. The method of claim 1, wherein the treated tobacco by-product material is combined with natural leaf tobacco.

17. The upgraded tobacco by-product material produced by the method of claim 1.

18. The smoking material produced by the method of claim 15.

19. The smoking material produced by the method of claim 16.

20. A smoking article containing the upgraded tobacco by-product material produced by the method of claim 1.

21. A method of producing an upgraded reconstituted tobacco material comprising:

(a) adding Burley stem material to a tobacco by-product slurry;

(b) casting the slurry into sheet form; and (c) subjecting the sheet to a heat treatment step such that it experiences a weight loss of at least 10% and a water extraction step such that the water soluble constituents contained within the Burley stem material and the tobacco by-product material are removed therefrom.

22. The method of claim 21, which further includes the step of removing the nitrate salts from the water subsequent to the water extraction step and recombining the remaining water soluble constituents with the reconstituted tobacco material.

23. The upgraded reconstituted tobacco material produced by the method of claim 21.

* * * * *